United States Patent [19]

Buick

[11] 3,934,627

[45] Jan. 27, 1976

[54] FILLING MACHINES

[76] Inventor: Douglas Stewart Buick, 8 Duff St., Dundee, Scotland

[22] Filed: Aug. 15, 1974

[21] Appl. No.: 497,725

[52] U.S. Cl. ..... 141/146; 141/152; 222/168.5; 222/309

[51] Int. Cl.[2] ..... B65B 57/06

[58] Field of Search ..... 141/140–152, 141/158, 286; 222/168.5, 189, 305, 306, 309, 387, 366, 444, 571; 137/625.68; 251/324

[56] References Cited

UNITED STATES PATENTS

| | | | |
|---|---|---|---|
| 2,989,092 | 6/1961 | Whitecar | 141/152 |
| 3,172,436 | 3/1965 | Wilhere et al. | 141/152 |
| 3,410,377 | 11/1968 | Riedel et al. | 141/152 |
| 3,580,302 | 5/1971 | Riesenberg | 141/152 |
| 3,658,100 | 4/1972 | Fechheimer et al. | 141/152 |
| 3,835,898 | 9/1974 | Leonard | 141/152 |

*Primary Examiner*—Houston S. Bell, Jr.
*Attorney, Agent, or Firm*—Larson, Taylor and Hinds

[57] ABSTRACT

A filling machine for filling containers includes a receptacle for holding the substance to be filled and cylinders disposed in a circle around the exterior of the receptacle and connectible to the receptacle and to discharge openings. Each cylinder contains a piston supporting a stub shaft projecting radially outwards from the axis of the cylinder. A sleeve axially movable on each stub shaft, and lockable on the stub shaft supports, slipper means in sliding contact with upper and lower tracks of an endless track member surrounding the central receptacle. Means is provided for altering the angles the planes of the upper and lower tracks make with the axes of the cylinders and for rotating the central receptacle and the cylinders about the vertical axis of the central receptacle relatively to the track.

10 Claims, 2 Drawing Figures

FILLING MACHINES

Figure 1:
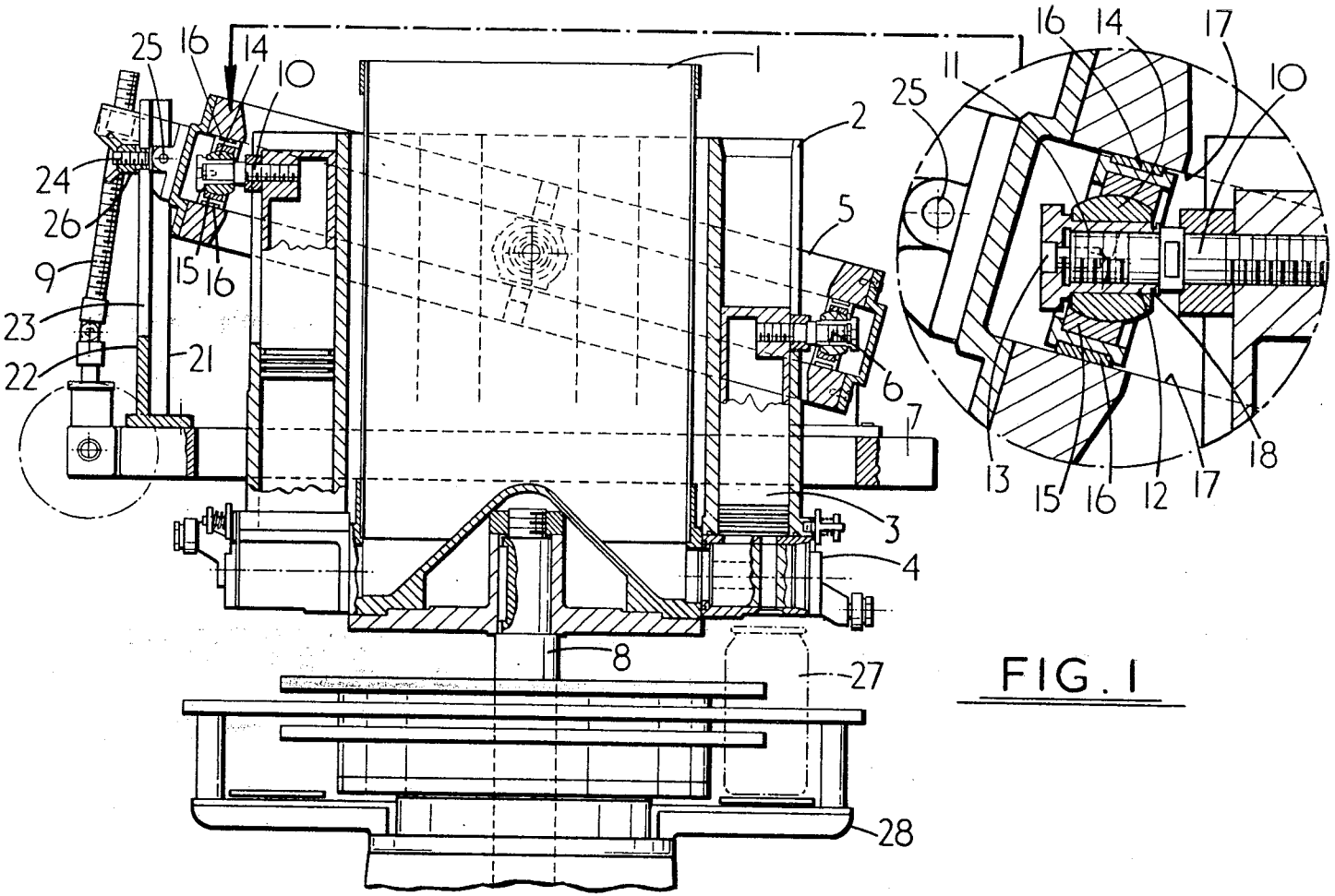

This invention relates to filling machines and particularly to rotary piston filling machines for filling semi-viscous products such as jams, soups, etc. into open mouthed containers such as glass jars and cans.

Filling machines for filling glass containers and cans are already well known. One customary construction includes an assembly consisting of a central container for holding the substance to be filled surrounded by cylinders disposed in a circle around the exterior of the container, the axes of the cylinders being vertical, each cylinder containing a piston which is in connection with an endless track member presenting upper and lower tracks surrounding the central container, each cylinder having a valve means at the bottom of the cylinder, and means being provided for rotating the assembly consisting of the central container and the cylinders about the axis of the central container while the track is held stationary, a turntable arranged to be fed with the containers to be filled being located below the cylinders and being rotatable with the said assembly. In operation of this machine as the container with the cylinders rotates the inclined track causes the pistons to reciprocate in the cylinders while the valve means associated with each cylinder also operates to permit each cylinder to receive material to be filled from the central container as the associated piston is rising in the cylinder and to expel the material from the cylinder into a container located directly below as the piston moves outwards. In the known machine each piston presents a stub shaft projecting radially outwards and the stub shaft carries a roller in engagement with the track. It will be understood that to permit the quantity of material to be filled into each container to be varied the track itself is swingable about a horizontal pivot, this action changing the angularity of the track with respect to the axis of the central container. This varies the stroke of each piston. To accommodate for the change in angularity each roller has its running surface formed synelastically so that the roller will still remain in rolling contact with the track at different angular positions of the track. This of course means point contact of the roller on the track.

Additionally, since the pistons have to be driven both upwards and downwards the track must be formed to contact each roller first on the underside and then on the upperside. So that there is continuity of driving the upper track overlaps the lower track over the portions corresponding with the top and bottom of the stroke of each piston. This means that during operation of the machine there is a short distance over which each roller is in contact with both tracks simultaneously. The result of this is that the thrust on each roller at this position is in the same direction above the roller centre and below the roller centre thus trying to cause the roller to rotate in opposite directions at the same time. This causes considerable wear on the roller and this wear of course is aggravated by the point contact. The result is that each roller becomes non-circular thus introducing play and reducing the accuracy of the metering action of each cylinder.

There is an additional disadvantage associated with the known machines. It is well known that cylinders which appear to be physically identical have different volumetric efficiencies. The effect of this is that individual cylinders will fill different quantities of material into the containers. The trouble here is that there are statutory regulations which require that the minimum quantity within a specific container must not be less than that which the container is stated to contain. Thus it has been heretofore necessary to arrange that the quantity of material pumped by the cylinder with the lowest output is not less than the statutory minimum so that all the other cylinders are pumping more than is necessary and are actually filling too much material into the respective containers. When it is understood that a machine of this kind is capable of filling many thousands of containers each day the quantity of excess material filled becomes a heavy additional charge on the production cost and yet cannot be recovered in the selling cost.

It is an object of the present invention to provide a filling machine which does not suffer from these disadvantages, i.e. a filling machine in which the stroke of the piston of each cylinder can be separately adjusted to provide a discharge volume on each stroke which is very close to the minimum required, and in which the wear on the driving mechanism for the pistons is reduced to very small proportions.

According to the invention a filling machine of the type described incorporates mounted on the stub shaft of each piston a sleeve which is coaxial with the stub shaft and is axially movable on the shaft, locking means for locking each sleeve in a chosen axial position on its stub shaft, and slipper means supported by each sleeve in driving contact with the tracks.

In one construction the sleeve supports an inner member which has the form of an equatorial zone of a sphere and an outer member formed with an inner surface is engaged with the spherical surface of the inner member, said outer member presenting flat bearing surfaces engaged with the upper and lower tracks of the track member.

The flat bearing surfaces may be formed of a low friction material such as PTFE or a sintered material impregnated with a lubricant or may be a graphitized surface.

In one particular construction the stub shaft is screw-threaded on the outside, and the sleeve is screw-threaded internally and engages the screw thread on the stub shaft, the inner member being mounted on the sleeve and the sleeve being fitted with means such as a clip to prevent withdrawal of the spherical member from the sleeve and ensure that the inner member is movable axially with the sleeve, the radially outer end of the sleeve being blanked off and being penetrated by a locking screw which is engaged with a screw-thread axial hole in the end of the stub shaft.

The track member may be formed in halves, one half being permanently pivoted to the fixed support and the other half being movable towards and from said one half.

A connection incorporating sliding guide bars may be provided between the halves of the track member so that the said halves are held in alignment irrespective of their relative positions. When the track member halves are withdrawn partly from one another there will be a gap between the halves. The adjacent ends of the halves may be formed with straight aligned recesses in each aligned pair of which a connecting feather is placed, the feather being fixed to one half of the track so that it can slide in the recess in the other half, the surface of each track and the associated feather being flush with one another. The provision for withdrawing the halves of the track member from one another is to compensate for changes in the angular position of the track because as the track member approaches the position in which the axis of the track member coincides with the axis of the central receptacle the portion of the track member remote from the pivot moves further out from the axis of the receptacle and to compensate for this the halves of the track member are brought closer together: The feathers in the recesses in the tracks permit the slipper to move smoothly from one half of the track member to the other half as the cylinders rotate with the central receptacle.

The machine may incorporate a fixed column having a surface parallel to the rotational axis of the central receptacle, and a clamp arranged to clamp the movable half of the track member to the surfaces at a chosen position along the column which corresponds to a particular angle of inclination of the track member.

The clamp may be a screw-threaded pin pivoted to the movable half of the track member and penetrating a slot in the column disposed along the length of the surface, a nut, conveniently of the wing type engaged with the screw-threaded pin being tightenable against the column to clamp the movable half of the track member to the column.

The column may bear indicia located on or close to the surface corresponding with particular angles of inclination of the track member or some other parameter such as volume delivered by each cylinder, a particular angle of inclination or volume of displacement being attained by tightening the clamp at a position opposite the index corresponding with that angle or volume.

The column may be mounted on the same fixed support as the pivoted half of the track member.

Figure 2:
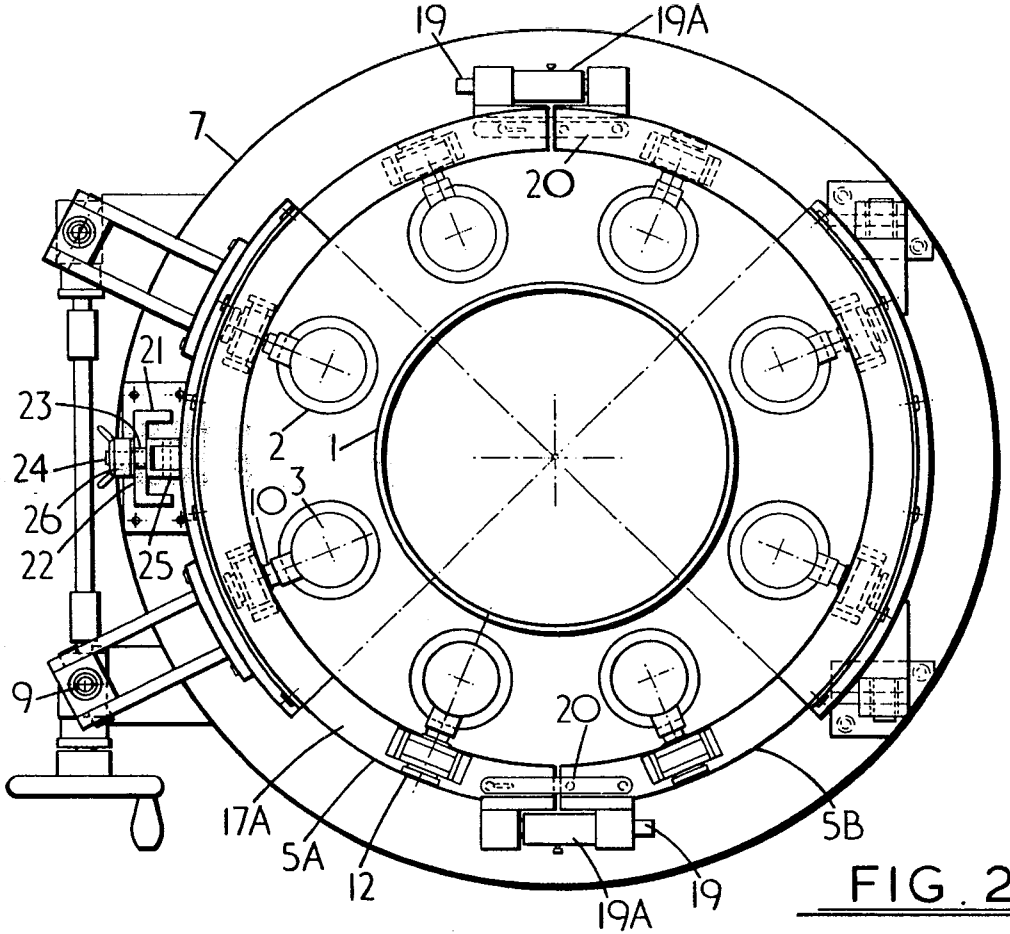

A practical embodiment of the invention is illustrated in the accompanying drawings in which FIG. 1 is an elevation in part section through the container-filling part of the filling machine, the driving mechanism not being shown since it is of customary construction and FIG. 2 is a plan view of the filling head.

In the drawings 1 denotes a central receptacle for holding the substance to be filled and 2 denotes cylinders disposed in a circle around the exterior of the receptacle 1, each cylinder containing a piston 3 and being fitted with valve means 4 at the bottom of the cylinder. 5 denotes an endless track member pivoted at 6 to a fixed support ring 7 surrounding the container 1 and the cylinders 2, the support ring 7 and the fixed track member 5 being held stationary but the central receptacle 1 with the cylinders 2 being rotatable by the shaft 8 on which they are supported. 9 denotes a piston stroke adjusting screw engaged with a portion of the track member 5 diametrally opposite the pivot 6 for adjusting the angle of inclination of the track member 5 relative to the axis of the receptacle 1. Each piston 3 presents a stub shaft 10 projecting radially outwards with respect to the receptacle 1. Each stub shaft 10 is screw-threaded at 11 on the outside, the screw thread 11 being engaged with an internally screw-threaded sleeve 12. A locking screw 13 is engaged with an axial screw-threaded hole in the stub shaft 10 and may be operated to lock the sleeve 12 in a particular axial position on the stub shaft 10. The sleeve 12 supports an inner member 14 having the form of an equatorial zone of a sphere, an outer member 15 engaging the spherical surface of the inner member 14 and being formed itself with upper and lower flat slippers 16 which engage parallel upper and lower track surfaces 17 on the track member 5. 18 denotes a spring clip retaining the inner member 14 in a fixed axial position on the sleeve 12.

The track member 5 is formed in halves 5A and 5B coupled to one another by means of guide bars 19 slidable in sockets 19A. Any gap which may exist between the track member halves 5A and 5B is bridged by feathers 20, each feather being fixed in a recess in one half of the track member and being slidable in an aligned recess in the other half so that a continuous track surface is presented to the slippers 16.

21 denotes a column mounted on the support ring 7, the column being formed with a surface 22 parallel with the rotational axis of the receptacle 1. The column is also formed with a slot 23. 24 denotes a screw-threaded pin pivoted at 25 to the movable half 5A of the track member 5, the pin 24 penetrating the slot 23 in the column 21. 26 denotes a wing nut engaged with the pin 24. The surface 22 carries indicia showing an appropriate parameter such as angle of inclination of the track member 5, or the volume displaced by the piston of each cylinder in one revolution of the receptacle 1.

To facilitate withdrawal of any of the pistons for servicing purposes without requiring to dismantle the machine a portion 17A of the portion of the track member 5 carrying the upper track is cut away. This is on the side in which the pistons are being raised on operation of the machine so that the thrust on the outer member 15 is by the lower track 17.

27 denotes jars to be filled resting on a turntable 28 below the filling head, the mechanism for feeding jars for filling being of a well known type.

In practice, when the machine is in operation irrespective of the angularity of the track member 5 the outer members 15 mounted on each stub shaft 10 can swing about the inner member 14 to the position necessary to maintain the slippers 16 in contact with the tracks. Thus always large sliding surfaces instead of point contact rollers as in the known construction are presented between the said outer members 15 and the tracks so that wear is reduced to a minimum. This of course helps to maintain accuracy in the metering action of the cylinders. To adjust the machine so that each cylinder 2 delivers as close as possible to the minimum quantity of material into each container a trial run or a series of trial runs is made by the machine and the quantity of material delivered by each cylinder 2 is noted. Adjustment of the quantity delivered by each cylinder 2 to the desired quantity is made by moving the sleeve 12 on the associated stub shaft 10 of each cylinder 2 axially on the stub shaft 10 to vary the stroke of the piston 3 since such axial movement on the stub shaft varies the distance of the slipper 16 from the pivotal point 6 of the track member thus varying the stroke of the associated piston 3.

To change the quantity of material to be delivered to each jar the angle of inclination of the track with respect to the axis of rotation of the receptacle 1 is altered. This is done by loosening the nut 26 and moving the pin 24 along the slot 23 by means of the adjusting screw 9 to the position indicated by the indicia marked on the surface 22 as being the appropriate position for delivery of the required quantity to each jar, vertical movement of the pin 24 causing the track member to swing about its pivot 16. The nut 26 is then tightened thus locking the track member 5 in the new position.

While the pin 24 is moving along the slot 23 the column 21 acts as an inclined plane with respect to the track member 5 and automatically moves the halves 5A and 5B of the track member 5 towards or from one another according to the direction of movement of the pin 24 thus automatically reducing or increasing the elongation of the track member 5 in conformity with its change of angularity so that its configuration as projected on a plane normal to the axis of rotation of the receptacle 1 will always be substantially circular. The guide bars 19 slide in the sockets 19A as the halves of the track member 5 move relatively to one another so as to maintain the halves continuously in alignment.

What is claimed is:

1. A filling machine for filling containers includes a receptacle for holding the substance to be filled, cylinders disposed in a circle around the exterior of the receptacle, the axes of the cylinders being vertical, a piston slidable in each cylinder, an endless track member presenting parallel upper and lower tracks surrounding the central receptacle, means for altering the angles the planes of the upper and lower tracks make with the axes of the cylinders, means for rotating the central receptacle and the cylinders about the vertical axis of the central receptacle relatively to the track, feeding means for containers to be filled located below the cylinders, a stub shaft supported by each piston and projecting radially outwards from the axis of the receptacle, a sleeve mounted on each stub shaft coaxially therewith and axially movable to different operative positions along the shaft relative to the track, to vary the position of that sleeve radially relative to the track to vary the stroke of that piston independently of the other pistons for a given position of the track, locking means for locking each sleeve in any chosen one of said different operative axial position on its stub shaft, and slipper means supported by each sleeve in sliding contact with the tracks.

2. A filling machine as claimed in claim 1 in which an inner member which has the form of an equatorial zone of a sphere is supported by the sleeve and an outer member formed with an inner spherical surface is engaged with the spherical surface of the inner member, said outer member presenting flat bearing surfaces engaged with the upper and lower tracks of the track member.

3. A filling machine as claimed in claim 2 in which the stub shaft is screw-threaded on the outside, and the sleeve is screw-threaded internally and engages the screw thread of the stub shaft, the inner member being mounted on the sleeve, and means is provided to prevent withdrawal of the spherical member from the sleeve and ensure that the inner member is movable axially with the sleeve.

4. A filling machine as claimed in claim 1 in which the stub shaft is formed with a screw-threaded axial hole, the radially outer end of the sleeve is blanked off, and a locking screw penetrates the blanked off end of the sleeve and is engaged with a screw-threaded axial hole in the end of the stub shaft whereby to constitute the locking means for the sleeve.

5. A filling machine as claimed in claim 1 in which the track member is formed in halves, one half being permanently pivoted to a fixed support and the other half being movable in the plane of said one half towards and from said one half.

6. A filling machine as claimed in claim 5 incorporating guide bars interconnecting the halves of the track member.

7. A filling machine as claimed in claim 5 in which the adjacent pairs of ends of the halves are formed with straight aligned recesses and a connecting feather is located in each aligned pair of recesses, the feather being fixed in one half of the track member so that it can slide in the recess in the other half, the surface of each track and the associated feather being flush with one another.

8. A filling machine for filling containers as claimed in claim 5 incorporating a fixed column having a surface parallel with the rotational axis of the receptacle and a clamp connecting the track member to the vertical column, the clamp being operable to lock the track member to the column at a chosen point on the surface thus holding the track member at a chosen angle of inclination.

9. A filling machine as claimed in claim 8 in which the clamp includes a screw-threaded pin pivoted to the track member, the column is formed with a slot along the length of the surface, the screw-threaded pin penetrating the slot, and a nut engaged with the pin is operable to clamp the pin and thus the track member at a chosen position along the slot.

10. A filling machine as claimed in claim 8 in which the column is marked with indicia corresponding with desired parameters associated with the angle of inclination of the track member with respect to the rotational axis of the receptacle.

* * * * *